United States Patent [19]

DeDino

[11] Patent Number: 4,953,700

[45] Date of Patent: Sep. 4, 1990

[54] DISPLAY CARD FOR A BATTERY PACKAGE

[75] Inventor: Jeffery L. DeDino, Kirtland, Ohio

[73] Assignee: The Shelby Paper Box Company, Canterbury, Ohio

[21] Appl. No.: 477,248

[22] Filed: Feb. 7, 1990

[51] Int. Cl.[5] ..... B65D 73/00

[52] U.S. Cl. ..... 206/333

[58] Field of Search ..... 206/333

[56] References Cited

U.S. PATENT DOCUMENTS

| | | | |
|---|---|---|---|
| 1,090,624 | 3/1914 | Kaempfer | 206/333 |
| 2,081,656 | 5/1937 | Anthony | 206/333 |
| 3,712,695 | 1/1973 | Kaye | 206/333 X |
| 3,995,767 | 12/1976 | Brindley et al. | 206/333 |

*Primary Examiner*—William I. Price

*Attorney, Agent, or Firm*—Tarolli, Sundheim & Covell

[57] ABSTRACT

A battery package includes a display card and a plastic casing rotatably mounted on the display card. The display card and the plastic casing define therebetween a plurality of compartments uniformly arranged in a circular path. Each of the compartments is provided for storing a battery. The display card includes a first panel having a conductive surface thereon and a second panel overlying the conductive surface of the first panel and having a non-conductive outer surface thereon. The second panel has an opening extending therethrough to expose a portion of the conductive surface of the first panel. The opening in the second panel is located relative to the circular path through which the batteries move so that at least one of the batteries in the circular path is partly in contact with the non-conductive surface and partly in contact with the conductive surface on the first panel. Electrical testing of the one battery is thereby enabled by a first test probe which engages the one battery and a second test probe which engages the conductive surface of the first panel. The first and second panels are interconnected by a fold line. At least a portion of the conductive surface of the first panel is exposed through the opening in the second panel when the first and second panels are folded along the fold line interconnecting the first and second panels.

16 Claims, 2 Drawing Sheets

DISPLAY CARD FOR A BATTERY PACKAGE

TECHNICAL FIELD

The present invention relates to a display card for a battery package, and in particular to a display card for supporting a plurality of batteries for movement in a circular path and for enabling electrical testing of each of the plurality of batteries.

BACKGROUND

Battery packages for storing a plurality of batteries are known. Typically, a battery package includes a display card on which the plurality of batteries are supported and a housing member rotatably secured to the display card. A plurality of storage chambers for storing the batteries are defined between the display card and the housing member. A battery is removed from a storage chamber by aligning the battery with an opening in the display card and then withdrawing the battery through the opening. Some battery packages permit electrical testing of the batteries while stored in their storage chambers. One way to electrically test a battery is to directly position a first probe on one terminal o the battery and to directly position a second probe on a portion of a conductive foil which is in electrical contact with the other terminal of the battery. The first and second probes are electrically connected to a voltmeter which provides an indication of the voltage across the battery being tested.

These battery packages have not been entirely satisfactory. First, the display card for the battery package has been relatively wide. Second, it is costly to print on the conductive foil because the conductive foil needs to be shellacked before printing thereon. Third, the conductive foil of a battery package is typically exposed and thus can be scratched causing the battery package to be unattractive in appearance.

It is desirable to minimize production costs in manufacturing a battery package including the display card for the battery package. To minimize production costs, especially material costs, it is desirable to minimize the width of the display card, and thickness of the material of which the display card is made. Further, to minimize production costs and to simplify printing on the display card, it is desirable to not have to print on any portion of the conductive foil. By not printing on the conductive foil, the step of having to shellac the conductive foil can be eliminated. Also, by not exposing the conductive foil, the conductive foil cannot be scratched which would cause the battery package to be unattractive in appearance.

SUMMARY OF THE INVENTION

In accordance with the present invention, a display card is provided for supporting a plurality of batteries for movement in a circular path and for enabling electrical testing of each of the plurality of batteries. The display card includes a first panel having a conductive surface thereon. The display card further includes a second panel overlying the conductive surface of the first panel. The second panel has a non-conductive outer surface and an opening extends therethrough to expose a portion of the conductive surface of the first panel. The opening in the second panel is located relative to the circular path through which the batteries move so that at least one of the plurality of batteries in the circular path is partly in contact with the exposed portion of the conductive surface and partly in contact with the non-conductive surface. This enables electrical testing of the one battery by a first test probe which engages the one battery and a second test probe which engages the conductive surface of the first panel. By having at least one of the plurality of batteries partly in contact with the exposed portion of the conductive surface and partly in contact with the non-conductive surface, the width of the first and second panels can be minimized.

Preferably, the first and second panels are interconnected by a fold line. When the first and second panels are folded along the fold line interconnecting the first and second panels, the second panel covers the entire conductive surface on the first panel except (i) that portion of the conductive surface of the first panel exposed through the opening in the second panel, and (ii) that portion of the conductive surface of the first panel engaged by the second test probe. Since substantially the entire conductive surface on the first panel is covered, the chance of scratching the conductive surface is minimized.

Also, by interconnecting the first and second panels with a fold line and thereby enabling the first and second panels to be folded along the fold line, the inner abutting surfaces of the panels can be provided with the conductive surface, and all printing can be put on non-conductive outer surfaces of the panels. This simplifies printing on the display card in that printing on the conductive surfaces is not required and thus shellacking thereof is not required. Further, since the conductive surfaces are not exposed, scratching of the conductive surfaces does not occur which would affect the appearance of the display card.

BRIEF DESCRIPTION OF THE DRAWINGS

The foregoing and other features and advantages of the present invention will become apparent to one skilled in the art to which the present invention relates from reading the following description of a preferred embodiment of the present invention in conjunction with the accompanying drawings, wherein.

DESCRIPTION OF A SPECIFIC PREFERRED EMBODIMENT OF THE INVENTION

Figure 1:
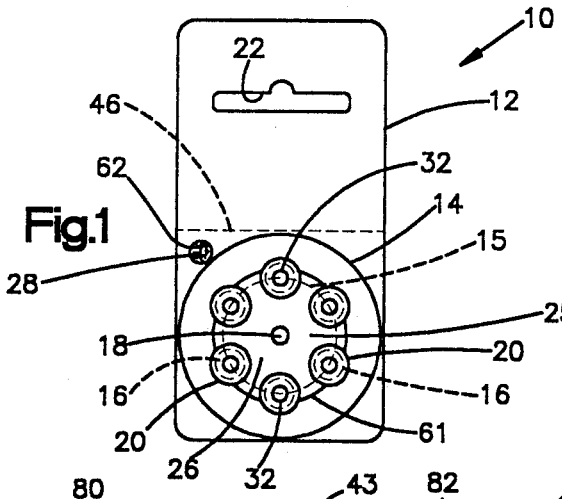
FIG. 1 is a front view of a battery package incorporating a display card constructed in accordance with the present invention.

The present invention relates to a display card for supporting a plurality of batteries for movement in a circular path and for enabling electrical testing of each of the plurality of batteries. The specific construction and use of the display card may vary. As an example, the display card of the present invention is illustrated in FIG. 1 as embodied in a battery package 10 for storing a plurality of batteries 16. The battery package 10 includes a display card or first housing member 12 and a second housing member 14 rotatably mounted on the display card 12.

The plurality of batteries 16 are supported on the display card 12 for movement in a circular path designated with the dashed line 15. The second housing member 14 is a circular molded piece of plastic casing which is rotatably mounted via a stud 18 to the display card 12. The plastic casing 14 can thus spin on the stud 18 and rotatably move relative to the display card 12.

The display card 12 and the plastic casing 14 define a plurality of compartments 20 uniformly arranged in the circular path 15 for storing the plurality of batteries 16. Each of the plurality of batteries 16 is stored in an associated one of the plurality of compartments 20. The display card 12 has an elongate-shaped opening 22 for allowing the battery package 10 to be hooked onto a display hanger, for example.

The display card 12 has a circular opening 61 through which a portion 25 of a conductive foil 26 is exposed. One terminal of each of the plurality of batteries 16 is partly in contact with the display card 12 and partly in contact with the portion 25 of the conductive foil 26. As shown in FIG. 1, a crescent-shaped portion of each of the batteries 16 lies in contact with the display card 12. The remaining portion of each of the batteries 16 lies in contact with the portion 25 of the conductive foil 26. The portion 25 of the conductive foil 26 is electrically continuous with another portion 28 of the conductive foil 26.

The portion 28 of the conductive foil 26 is exposed through a circular opening 62 in the display card 12. The opening 62 in the display card 12 is spaced apart from the opening 61 in the display card 12.

The plastic casing 14 has a plurality of small circular openings 32 extending therethrough. The number of the openings 32 corresponds to the number of the compartments 20 defined between the plastic casing 14 and the display card 12. Each one of the compartments 20 has an associated one of the openings 32 through which a first test probe (not shown) may be inserted. Each one of the openings 32 allows the first test probe to engage one terminal of the battery stored in the associated one of the compartments 20. This specific construction of the plastic casing 14 allows the batteries 16 t be electrically tested while the batteries 16 are stored in their associated compartments 20.

To test one of the batteries 16 without having to remove it from its storage compartment, the first test probe is inserted through the associated one of the openings 32 to engage one terminal of the battery to be tested. A second test probe (not shown) is directly placed in contact with the portion 28 of the conductive foil 26. Since the portion 28 of the conductive foil 26 is electrically continuous with the portion 25 of the conductive foil 26 and the portion 25 is in direct electrical contact with the other terminal of the battery to be tested, the second test probe is electrically connected to the other terminal of the battery to be tested. Thus, the first test probe is electrically connected to the one terminal and the second test probe is electrically connected to the other terminal of the battery to be tested. The first and second test probes are electrically connected to a voltmeter (not shown) which provides an indication of the voltage across the battery being tested. Electrical testing of the battery is thereby enabled while the battery is stored in its associated storage compartment.

A discharge outlet 23 (shown only in FIG. 7 and not shown in FIG. 1) is located on the opposite side of the display card 12. The discharge outlet 23 is located in the circular path 15 of movement of the batteries 16. When it is desired to withdraw one of the batteries 16 from its associated storage compartment, the battery to be removed is aligned with the discharge outlet 23 by spinning the plastic casing 14 on the stud 18 and rotatably moving the plastic casing 14 relative to the display card 12. As the plastic casing 14 moves relative to the display card 12, the batteries 16 move along the circular path 15. While the batteries are moving along the circular path 15, the terminal of each of the batteries at least partly in contact with the portion 25 of the conductive foil 26 remains partly in contact therewith. After the battery to be removed is aligned with the discharge outlet 23, the battery is withdrawn through the discharge outlet 23.

Figure 2:
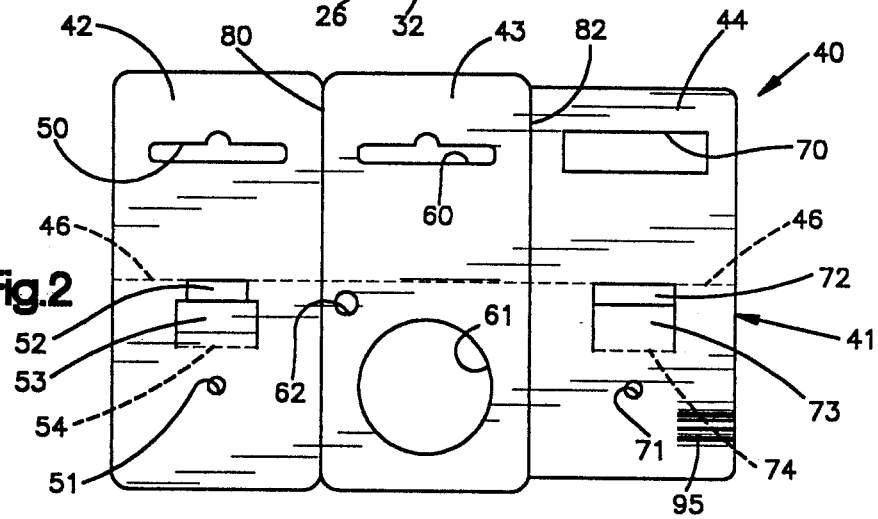
FIG. 2 is a front view of a blank from which the display card of FIG. 1 is formed.
Figure 3:
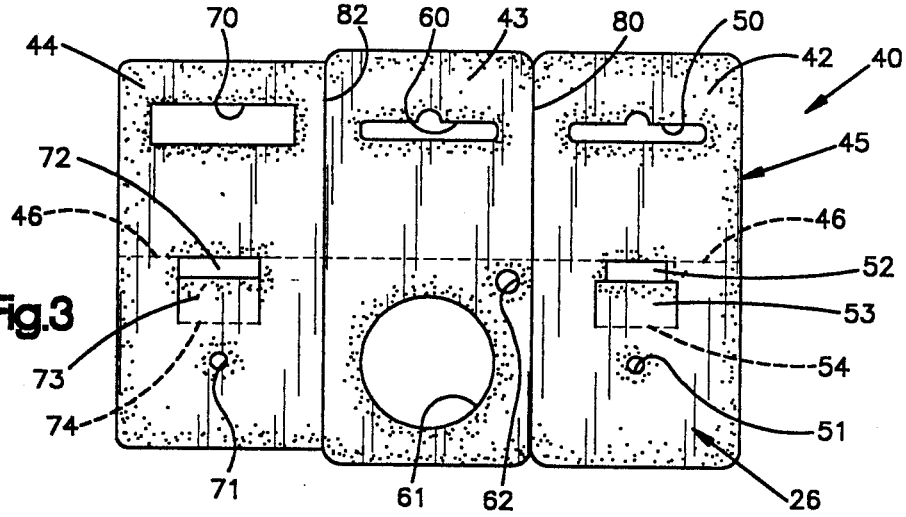
FIG. 3 is a rear view of the blank of FIG. 2.

The specific construction of the display card 12 is described hereinbelow. The display card 12 is made from a cardboard blank 40, as shown in FIG. 2. The blank 40 has a major side surface 41 as shown in FIG. 2 and another major side surface 45 as shown in FIG. 3. The blank 40 is divided into three panels 42, 43, 44 and has a perforation 46 which extends across each of the three panels 42, 43, 44.

The panel 42 has an elongate-shaped opening 50 extending therethrough and a small hole 51 extending therethrough. The panel 42 also has a rectangular-shaped opening 52 extending therethrough. A tab portion 53 of the panel 42 is disposed adjacent the opening 52 and is hinged about a line 54 having perforations extending therealong. The panel 43 has an elongate-shaped opening 60 extending therethrough, the circular shaped opening 61 extending therethrough, and the smaller circular opening 62 spaced apart from the opening 61 as shown in FIG. 2. The panel 44 has a rectangular-shaped opening 70 extending therethrough and a rectangular-shaped opening 72 located adjacent to the perforation 46. A tab portion 73 of the panel 44 is disposed adjacent the opening 72 and is hinged about a line 74 having perforations extending therealong. The panel 44 also has a small hole 71 extending therethrough.

The panel 42 and the panel 43 are interconnected by a fold line 80. The panel 43 and the panel 44 are interconnected by a fold line 82. The major side surface 41 of the blank 40, namely the surfaces of the panels 42, 43, and 44 shown in FIG. 2, is non-conductive. The major side surface 45 of the blank 40, namely the surfaces of the panels 42, 43, and 44 shown in FIG. 3, has the conductive foil 26 disposed thereon.

Figure 4:
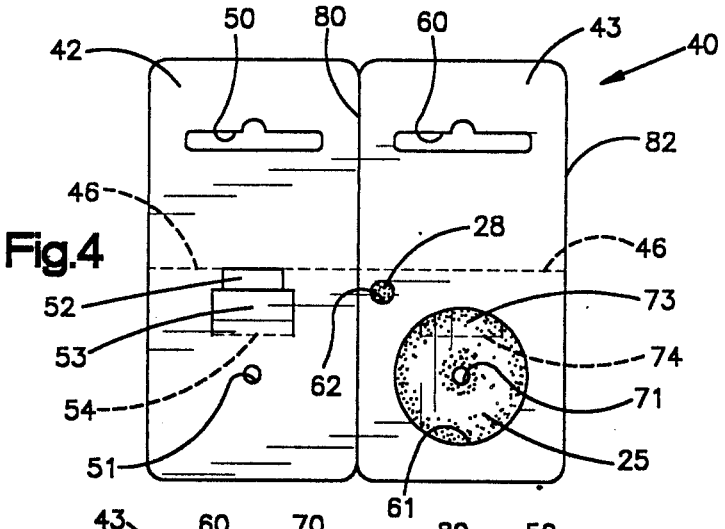
FIG. 4 is a front view of the blank of FIGS. 2 in a partially folded condition.
Figure 5:
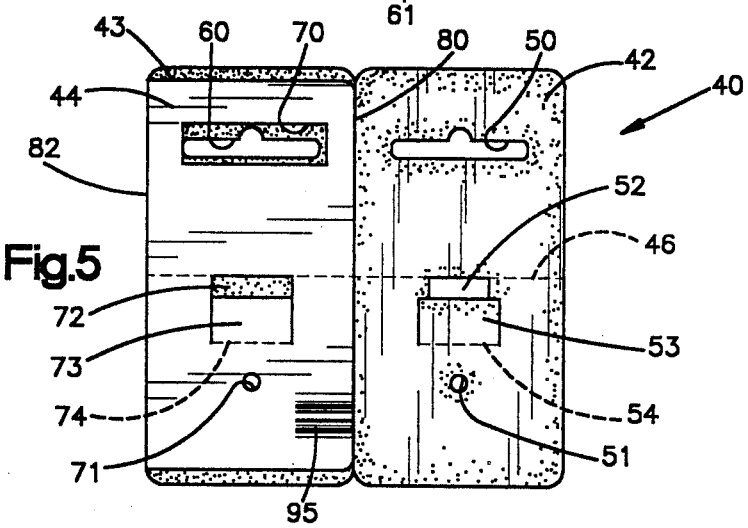
FIG. 5 is a rear view of the partially folded blank of FIG. 4.
Figure 6:
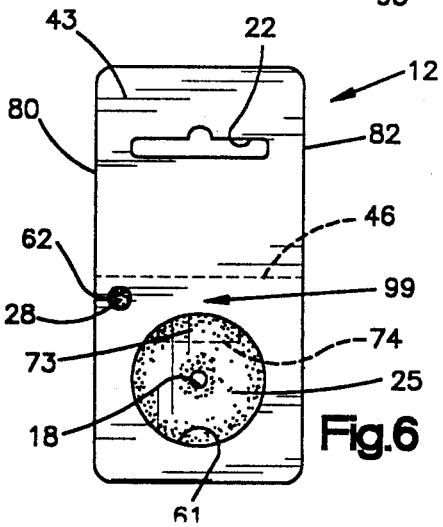
FIG. 6 is a front view of the display card formed from the blank of FIG. 2.
Figure 7:
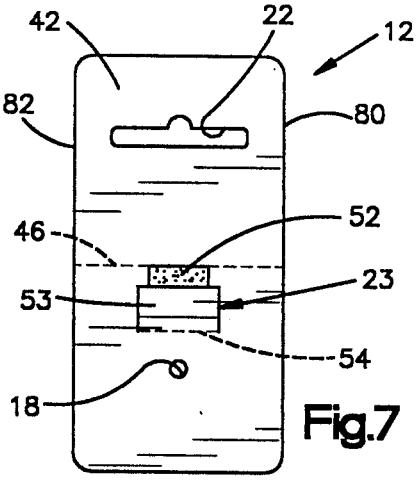
FIG. 7 is a rear view of the display card formed from the blank of FIG. 2.

The blank 40, as shown in FIGS. 2 and 3, is folded twice to provide the display card 12 as shown in FIGS. 1, 6, and 7. In a first folded position, as shown in FIGS. 4 and 5, the blank 40 is folded along the fold line 82 so that the portion of the conductive foil 26 disposed on the panel 44 is in abutting facing relationship with the portion of the conductive foil 26 disposed on the panel 43. In the first folded position, a portion of the conductive foil 26 disposed on the portion of the major side surface 45 on the panel 44 is exposed through the opening 61 in the panel 43. This portion of the conductive foil 26 exposed through the opening 61 in the panel 43 corresponds to the portion 25 of the conductive foil 26 as shown in FIG. 1.

Another portion of the conductive foil 26 disposed on the portion of the major side surface 45 on the panel 44 is exposed through the opening 62 in the panel 43. This portion of the conductive foil 26 exposed through the opening 62 in the panel 43 corresponds to the portion 28 of the conductive foil 26 as shown in FIG. 1. Also, in the first folded position of the blank 40, the rectangular opening 70 in the panel 44 overlies the elongate-shaped opening 60 in the panel 43 in the manner as best shown in FIG. 5. Further, the hole 71 in the panel 44 is located in the center of the opening 61 in the panel 43 when the blank 40 is in its first folded position as shown in FIGS. 4 and 5.

After the blank 40 is folded into its first folded position as shown in FIGS. 4 and 5, the blank 40 is folded into its second folded position to provide the display card 12 as shown in FIGS. 6 and 7. To fold the blank 40 into its second folded position, the blank 40 in its first folded position i folded along the fold line 80 so that the portion of the conductive foil 26 disposed on the panel 42 is in abutting facing relationship with the portion of the non-conductive major side surface 41 on the panel 44. A suitable adhesive such as glue is used to secure the portion of the conductive foil 26 disposed on the panel 42 to the portion of the non-conductive major side surface 41 on the panel 44.

In the second folded position of the blank 40, the panel 44 is sandwiched between the panel 42 and the panel 43. The circular hole 51 in the panel 42 aligns with the circular hole 71 in the panel 44 to form the opening 18 in the display card 12 as shown in FIG. 1. Also, in the second folded position, the elongate-shaped opening 50 in the panel 42 overlies the rectangular opening 70 in the panel 44 and the elongate-shaped opening 60 in the panel 43 to form the opening 22 shown in FIGS. 1, 6, and 7. The tab portion 53 and the tab portion 73 overlie each other to form a flap. The flap is pivotable about a hinge formed by the perforated line 54 and the perforated line 74.

The blank 40 in the second folded position, as shown in FIGS. 6 and 7, is the display card 12 used in the battery package 10 as shown in FIG. 1. The construction and function of the discharge outlet 23 is better understood with reference to FIGS. 6 and 7. After a battery to be removed from its storage compartment is positioned at approximately the location designated 99 on the display card 12 and is thereby aligned with the flap formed by the tab portions 53, 73, the flap is peeled back from an initial position. The flap is pivoted about the hinge formed by the perforated lines 54, 74 to provide the discharge outlet 23 for the battery to be withdrawn therethrough. The battery to be removed is then withdrawn from its storage compartment through the discharge outlet 23. After the battery is withdrawn from its storage compartment through the discharge outlet 23, the flap is returned to its initial position.

The construction of the two tab portions 53, 73 is such that the width of the tab portion 73, ie. the extent along the perforated line 74, is slightly larger than the width of the tab portion 53, ie. the extent along the perforated line 54. Thus, the inner tab portion, namely the tab portion 73, is slightly larger in width than the outer tab portion, namely the tab portion 53. By having the inner tab portion 73 slightly larger in width than the outer tab portion 53, a sufficient amount of friction is provided between the flap formed by the tab portions 53, 73 and the area adjacent the flap to hold the flap in its initial position, as is known.

By providing a battery package 10 including a display card 12 constructed in accordance with the present invention, printing on the display card 12 is simplified in that only the non-conductive side of the blank 40, ie. the major side surface 41 as shown in FIG. 2, is printed on. Thus, shellacking of any portion of the conductive foil 26 on the major side surface 45 as shown in FIG. 3 is not required before printing on the display card 12. The result is that production costs are minimized.

Also, the conductive foil 26 is not exposed except for the portions 25, 28 of the conductive foil 26. The portions 25, 28 of the conductive foil 26 are exposed only to enable electrical testing of the plurality of batteries 16 while stored in the plurality of compartments 20. Even though the portions 25, 28 of the conductive foil 26 are exposed, most of the conductive foil 26 is not exposed and the amount of exposure of the portions 25, 28 of the conductive foil 26 is kept at a minimum. The result is that the chance of scratching the conductive foil 26 and causing an unattractive appearance of the display card 12 is minimized.

Since each of the plurality of batteries 16 is partly in contact with the portion 25 of the conductive foil 26, each of the batteries 16 tilts inwards. This advantageously minimizes the size of the opening 61 through which the portion 25 of the conductive foil 26 is exposed, and therefor minimizes the overall width of the display card 12. The overall size of the battery package 10 is thereby minimized. Also, since the card 12 is a three panel card as opposed to a two panel card, it is possible to use material that is two-thirds the thickness of a two panel card.

By providing perforations instead of score lines for the lines 54, 74 in the blank 40, manufacturing problems such as canting of the blank 40, which can occur if the lines 54, 74 are score lines, are minimized. Thus, the holes 51, 71 in the blank 40 can be cut out in the flat simultaneously with the forming of the perforated lines 54, 74 without canting of the blank 40.

In the disclosed embodiment, a bar code 95 is printed along an edge portion of the non-conductive surface of the panel 44, i.e. the panel which is sandwiched between the panel 42 and the panel 43, as shown in FIG. 2. The bar code 95 extends to the edge of the panel 44. During manufacture of the display card 12, the bar code 95 is sensed to be certain the imprints are not misfed during the folding and glue application process, for example, to control machine processes, such as glue application, for example. Typically, such bar codes are printed at a location on a display card spaced from the edges of the display card. With the display card 12 constructed in accordance with the present invention, the bar code 95 on the panel 44 is hidden from view since the panel 44 is sandwiched between the panel 42 and the panel 43.

This invention has been described above with reference to a preferred embodiment. Modifications and changes may become apparent to one skilled in the art upon reading and understanding this specification. It is intended to cover all such modifications and changes within the scope of the appended claims.

Having described a specific preferred embodiment of the invention, the following is claimed:

1. An apparatus for supporting a plurality of batteries for movement in a circular path and for enabling electrical testing of each of the plurality of batteries, said apparatus comprising:

a first panel having a conductive surface thereon;

a second panel overlying said conductive surface of said first panel and having a non-conductive outer surface thereon and having a first opening extending therethrough to expose a portion of said conductive surface of said first panel, said first opening in said second panel being located relative to the circular path through which the batteries move so that at least one of the plurality of batteries in the circular path is partly in contact with said portion of said conductive surface and partly in contact with said non-conductive surface; and thereby enabling electrical testing of the one battery by a first test probe which engages the one battery and a second test probe which engages said conductive surface of said first panel.

2. An apparatus as defined in claim 1 wherein said second panel has a second opening therethrough spaced apart from said first opening to expose another portion of said conductive surface of said first panel, the second test probe being engageable with said portion of said conductive surface of said first panel exposed through said second opening.

3. An apparatus as defined in claim 1 wherein said second panel has a conductive surface in abutting facing relationship with said conductive surface of said first panel.

4. An apparatus as defined in claim 1 wherein said second panel includes means for allowing one of the plurality of batteries to be withdrawn from the circular path including a flap pivotably connected at a perforated line, said flap being pivoted at the perforated line to allow the battery to be withdrawn from the circular path.

5. An apparatus as defined in claim 1 wherein said first and second panels are interconnected by a first fold line, at least a portion of said conductive surface of said first panel being exposed through said first opening in said second panel when said first and second panels are folded along the first fold line interconnecting said first and second panels.

6. An apparatus as defined in claim 5 further including a third panel interconnecting said second panel by a second fold line, said first panel being sandwiched between said second and third panels when said first and second panels are folded along the first fold line and said second and third panels are folded along the second fold line.

7. An apparatus as defined in claim 6 wherein said first panel has a bar code extending to an edge of said first panel, the bar code being completely covered by said third panel when said first and second panels are folded along the first fold line and said second and third panels are folded along the second fold line.

8. An apparatus for supporting a plurality of batteries for movement in a circular path and for enabling electrical testing of each of the plurality of batteries, said apparatus comprising:

a first panel having a non-conductive surface and a conductive surface;

a second panel having a non-conductive surface and a conductive surface, said second panel having a first opening extending therethrough, said first and second panels being interconnected by a first fold line; and at least a portion of said conductive surface of said first panel being exposed through said first opening in said second panel when said first and second panels are folded along the first fold line interconnecting said first and second panels.

9. An apparatus as defined in claim 8 wherein said conductive surface of said first panel is in abutting facing relationship with said conductive surface of said second panel.

10. An apparatus as defined in claim 8 wherein said second panel includes means for allowing one of the plurality of batteries to be withdrawn from the circular path including a flap pivotably connected at a perforated line, said flap being pivoted at the perforated line to allow the battery to be withdrawn from the circular path.

11. An apparatus as defined in claim 8 wherein said first opening in said second panel is located relative to the circular path so that at least one of the plurality of batteries in the circular path is partly in contact with said portion of said conductive surface and partly in contact with said non-conductive surface and thereby enabling electrical testing of the one battery by a first test probe which engages the one battery and a second test probe which engages said conductive surface of said first panel.

12. An apparatus as defined in claim 11 wherein said second panel has a second opening therethrough spaced apart from said first opening to expose another portion of said conductive surface of said first panel, the second test probe being engageable with said portion of said conductive surface of said first panel exposed through said second opening.

13. An apparatus as defined in claim 8 further including a third panel interconnecting said second panel by a second fold line, said first panel being sandwiched between said second and third panels when said first and second panels are folded along the first fold line and said second and third panels are folded along the second fold line.

14. An apparatus as defined in claim 13 wherein said first panel has a bar code extending to an edge of said first panel, the bar code being completely covered by said third panel when said first and second panels are folded along the first fold line and said second and third panels are folded along the second fold line.

15. An apparatus comprising:

first and second housing members;

means for rotatably mounting said second housing member on said first housing member;

said first and second housing members defining therebetween a plurality of compartments uniformly arranged in a circular path, each of said plurality of compartments being provided for storing a battery, each of said plurality of compartments having an associated opening in said second housing member through which one terminal of the battery in said compartment is contactable with a test probe; and said first housing member including a first panel having a conductive surface thereon and a second panel overlying said conductive surface of said first panel and having a non-conductive outer surface thereon, said second panel having an opening extending therethrough to expose a portion of said conductive surface of said first panel, said opening in said second panel being located relative to the circular path through which the batteries move so that at least one of the plurality of batteries in the circular path is partly in contact with said non-conductive surface and thereby enabling electrical testing of the one battery by a first test probe which engages the one battery and a second test probe which engages said conductive surface of said first panel.

16. An apparatus comprising:

first and second housing members;

means for rotatably mounting said second housing member on said first housing member;

said first and second housing members defining therebetween a plurality of compartments uniformly arranged in a circular path, each of said plurality of compartments being provided for storing a battery, each of said plurality of compartments having an associated opening in said second housing member through which one terminal of the battery in said compartment is contactable with a test probe; and said first panel having a non-conductive surface and a conductive surface and a second panel having a nonconductive surface and a conductive surface, said second panel having an opening extending therethrough, said first and second panels being interconnected by a fold line, at least a portion of said conductive surface of said first panel being exposed through said opening in said second panel when said first and second panels are folded along the fold line interconnecting said first and second panels.

* * * * *